US005219296A

United States Patent [19]

Nguyen

[11] Patent Number: 5,219,296

[45] Date of Patent: Jun. 15, 1993

[54] MODULAR CONNECTOR ASSEMBLY AND METHOD OF ASSEMBLING SAME

[75] Inventor: Hung T. Nguyen, Harrisburg, Pa.

[73] Assignee: AMP Incorporated, Harrisburg, Pa.

[21] Appl. No.: 818,188

[22] Filed: Jan. 8, 1992

[51] Int. Cl.[5] ..... H01R 13/648

[52] U.S. Cl. ..... 439/95; 29/832; 439/362; 439/620

[58] Field of Search ..... 439/95, 620, 359, 362; 29/832

[56] References Cited

U.S. PATENT DOCUMENTS

| | | | |
|---|---|---|---|
| Re. 29,258 | 6/1977 | Fritz | 333/70 S |
| 4,262,268 | 4/1981 | Shimada et al. | 333/182 |
| 4,276,638 | 2/1981 | Farrar et al. | 439/620 R |
| 4,470,657 | 9/1984 | Deacon | 339/143 R |
| 4,679,013 | 7/1987 | Farrar et al. | 333/182 |
| 4,699,590 | 10/1987 | Farrar et al. | 439/95 |
| 4,709,253 | 11/1987 | Walters | 357/68 |
| 4,729,743 | 3/1988 | Farrar et al. | 439/276 |
| 4,746,310 | 5/1988 | Morse et al. | 439/620 |
| 4,747,789 | 5/1988 | Gliha | 439/620 |
| 4,820,174 | 4/1989 | Farrar et al. | 439/95 |
| 4,874,337 | 10/1989 | Paukovits, Jr. et al. | 439/609 |
| 4,880,397 | 11/1989 | Dawson, Jr. et al. | 439/620 |
| 5,007,858 | 4/1991 | Daly et al. | 439/498 |

OTHER PUBLICATIONS

AMP Catalog 73-162, "ARINC 404 Rack and Panel Connectors", revised Feb. 1990, pp. 1-9, AMP Incorporated, Harrisburg, Pa.

*Primary Examiner*—Eugene F. Desmond
*Attorney, Agent, or Firm*—Anton P. Ness

[57] ABSTRACT

A modular connector assembly comprises a main shell assembly having an aperture therethrough defining a inside surface. An electrical circuit assembly is disposed in the main shell aperture and includes a filter module and a transient suppression module each in electrical engagement with a plurality of electrical terminals. The filter and transient suppression module each define a conductive subassembly shell and each include grounding means disposed to engage the inside surface of the aperture in the main shell assembly in electrical grounding contact. Both the filter and transient suppression modules each define a first and second guide means disposed to engage first and second aligning means of the main shell member permitting facile precision assembly.

21 Claims, 7 Drawing Sheets

MODULAR CONNECTOR ASSEMBLY AND METHOD OF ASSEMBLING SAME

FIELD OF THE INVENTION

The present invention relates to the field of electrical connectors and more particularly to connectors having a plurality of terminals insulatively housed within a conductive shell and having associated circuit-protective components.

BACKGROUND OF THE INVENTION

The present invention relates to high-density, multiplecontact, conductively shielded electrical connectors which are used in a variety of applications. For example, in aircraft, such connectors are often used to interface wiring from various locations throughout the aircraft with processing circuitry of control units located within an electronics bay of the aircraft.

For convenience and flexibility, it is known to manufacture such connectors in the form of modular assemblies in which one or more connector modules or "modules" are fastened rearwardly of and partially within a shell member. Both the shell member and the modules are manufactured in a variety of standard configurations. The electrical connector assembly as a whole can then be mounted to a bulkhead or other mounting surface for use.

For even greater flexibility, the modules are removably mounted to the shell member. Accordingly, if replacement of a particular module is desired, it is a simple matter to remove the module from the shell member and mount a new module in its place. It is not necessary to replace the modular connector assembly as a whole or to interfere with other modules in the modular connector assembly.

In designing electrical circuitry for such connectors, the circuitry often must be protected from disruptions caused by electromagnetic interference ("EMI") including radio frequency interference ("RFI") entering the system. In addition to protecting or filtering electronic equipment against EMI, there is also a need to protect the equipment against power surges or suppress transients owing to lightning, electrostatic discharges ("ESD") and electromagnetic pulses ("EMP"). The high voltage generated by ESD and EMP can damage sensitive integrated circuits and the like.

Frequently today's electronic circuitry requires the use of high density, multiple contact electrical assemblies. As newer generation of electronics are packed into smaller spaces, the circuits become more susceptible to damage from the above types of energy. There are many applications in which it is desirable to provide a assembly with a filter capability, for example, to suppress EMI; and transient suppression means to suppress lightning, EMP and ESD interference or other undesired energy surges which may affect circuits connected by the assemblies.

Typical of the prior art describing filter modules are U.S. Pat. Nos. 4,820,174 and 4,699,590 which show one or more filter inserts positioned within a conductive shell. Typical of the prior art describing transient suppression inserts is U.S. Pat. No. 4,726,638 which shows a transient suppression system for protecting individual circuit boards.

To retain the convenience and flexibility of the modularity of the modular connector assembly, however, it is desirable that the filter and transient suppression capability be incorporated into the connector assembly in a truly modular manner that will permit full interchangeability between the filter and transient suppression modules, respectively, so that the modules can be connected to appropriate mating connectors or other circuits.

Typical of the prior art including both filter and transient suppression protection is U.S. Pat. No. 4,729,743 assigned to the assignee of the present invention. The connector assembly described in U.S. Pat. No. 4,729,743 includes filter and transient suppression subassemblies mounted entirely within an elongate conductive cylindrical shell member. Grounding paths are provided from the transient and filter subassemblies to the outer shell member by conductive ring members therearound being soldered or bonded by conductive epoxy to the conductive outer shell.

Other prior art grounding techniques for electrical connectors are described in U.S. Pat. Nos. 4,874,337, assigned to the present assignee, and 4,470,657. U.S. Pat. No. 4,874,337 describes a strip of spring fingers for providing grounding connections between metal shells of EMI connectors. The strip is wrapped around a plug-type shell within a recess thereof and is held in place by an elastomeric member, such as a O-ring. U.S. Pat. No. 4,470,657 describes a continuous "bracket-like" grounding and electromagnetic shielding device having axially extending flat fingers for placement in a circumferential shielding cavity formed by an annular groove in an overlapping body portions of mating electrical connectors.

A problem in the prior art has been the difficulty in achieving the proper mounting (and removal) of circuit protective modules, such as filter or transient suppression modules, entirely within an axially elongate main shell member to achieve proper alignment of electrical terminals and provide for grounding to protect the assembled electrical circuity within the modules. Further, ease of module replacement is particularly important in the aircraft environment where space is limited and speed of replacement paramount.

The devices described above provide important advantages in protecting a connector assembly by providing either (or both) filter and transient suppression protection. Nonetheless, none of these devices provides for the advantages of enhanced modularity of the filter and transient modules necessary to protect an electrical connector as accomplished by the present invention. None of the patents described above provides the important advantages of providing a modular connector assembly having EMI filter modules and EMP/ESD/-lightning transient suppression protection modules having improved mounting and replacement modularity and electrical grounding characteristics, particularly for high density, multi-contact electrical circuit assemblies. The modules of the present invention include a conductively enveloped subassembly which provides electrical grounding through a ground spring to the main (or outer) shell assembly. The ground spring affixed to each of the modules is replaceable and provides an incremental "float" which facilitates the insertion and removal of each of the modules with regard to the deep cavity of the main shell assembly. It also provides a degree of vibration control between the main shell assembly and the module subassembly shells thereby protecting electrical components within the protective modules.

SUMMARY OF THE INVENTION

It is an object of the present invention to overcome these problems by providing a modular connector assembly having circuit protection modules with improved mounting and replacement modularity coupled with improved electrical grounding characteristics.

It is a further object of the present invention to overcome these problems by providing a modular connector assembly having EMI filter modules and an EMP-/ESD/lightning transient suppression protection modules having improved mounting and replacement modularity as well as electrical grounding characteristics, wherein a continuous outer conductive shell necessarily defines a deep cavity to completely surround the modules the entire axial length thereof.

It is a still further object of this invention to provide EMP and EMI protection for high density, multi-contact electrical assemblies.

It is an additional object of this invention to provide an environmentally sealed modular connector assembly.

According to the invention, a modular connector assembly comprises a main shell assembly having an aperture therethrough defining an inside surface and a plurality of electrical terminal contacts secured in an array across an opening at a mounting face, the main shell assembly defining a first aligning means disposed within said aperture. A first module disposed in the aperture comprises a conductive subassembly shell in which are secured an array of electrical contacts defining circuit paths. The first module includes circuit protection elements disposed thereon which are electrically connected to respective ones of the contacts and also are electrically grounded to the subassembly shell. A first ground spring is disposed to engage the subassembly shell and the inside surface of the main shell assembly aperture in electrical contact thereby providing an electrical ground between the first module and the main shell assembly. A modular assembly means is disposed to fasten the first module to and within the main shell assembly in a manner to align the electrical contacts of the first module with the contacts of the main shell assembly. The ground spring provides an incremental float thereby defining a predetermined clearance between the first module and the main shell assembly upon engagement of the ground spring with the first aligning means.

Also, according to the present invention, a modular connector assembly comprises a main shell member having an aperture therethrough defining an inside surface, a first aligning means disposed within said aperture, and a second aligning means disposed on the inside surface of the aperture. A circuit assembly is disposed within the aperture and includes a filter module and a transient suppression module having respective arrays of electrical terminals in electrical engagement with a plurality of electrical terminals of the main shell assembly. The filter module comprises circuit filtering means such as capacitor and inductor members electrically engaging the electrical terminals and a filter shielding and grounding means disposed to engage the inside surface of the aperture in electrical contact. The filter module defines a first and second guide means disposed to engage the first and second aligning means of the main shell member. The transient suppression module includes at least one dielectric substrate member having a conductive path means disposed thereon, a plurality of apertures extending therethrough for receiving a plurality of the electrical terminals of the transient suppression module, transient suppression means electrically connected to respective electrical terminals and transient shielding and grounding means disposed to engage the inside surface of the aperture in electrical grounding contact. The transient suppression module defines a first and second guide means disposed to engage said first and second aligning means of the main shell member.

Also, according to the present invention, a method of assembling the filter and transient suppression modules within the main shell assembly of a modular connector assembly is described.

Preferably, the filter or transient suppression modules of present invention include a conductive subassembly which provides electrical grounding through a ground spring to the main or outer shell assembly.

As pointed out in greater detail below, this invention provides the important advantages of providing a modular connector assembly having EMI filter modules and an EMP/ESD/lightning transient suppression protection modules having improved mounting and replacement modularity and electrical grounding characteristics, particularly for high density, multi-contact electrical circuit assemblies. The modules of the present invention include a conductive subassembly which provides electrical grounding through a ground spring to the main shell assembly. The ground spring affixed to each of the modules is replaceable and provides an incremental "float" which facilitates the insertion and removal of each of the modules. It also provides a degree of vibration control between the main shell assembly and the subassembly shells thereby protecting electrical components positioned within the modules.

The invention itself, together with further objects and attendant advantages, will best be understood by reference to the following detailed description taken in conjunction with the accompanying drawings.

DETAILED DESCRIPTION OF THE INVENTION

Figure 1:
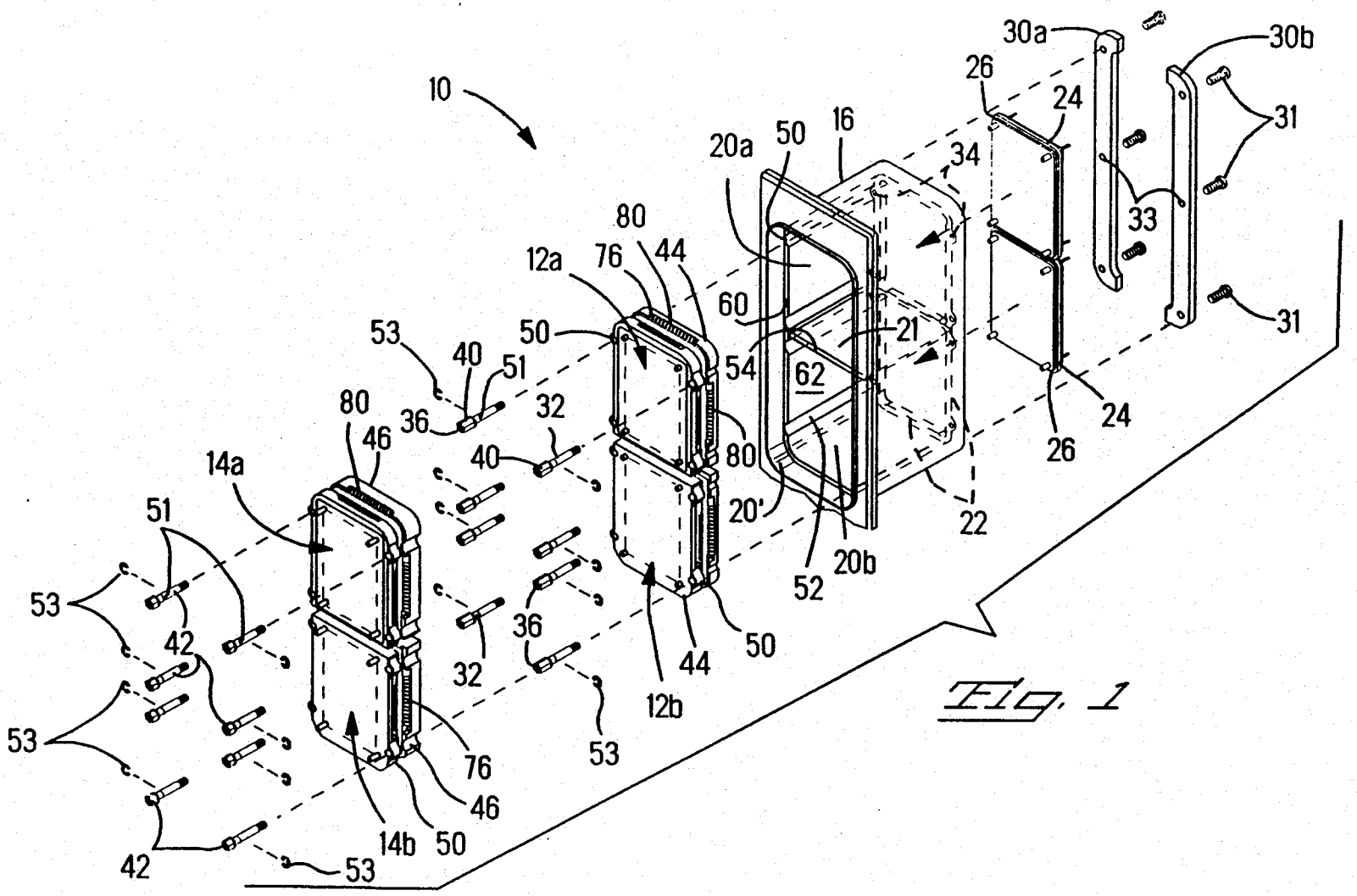
FIG. 1 is an exploded isometric view of a modular connector assembly according to a presently preferred embodiment of the invention.
Figure 2:
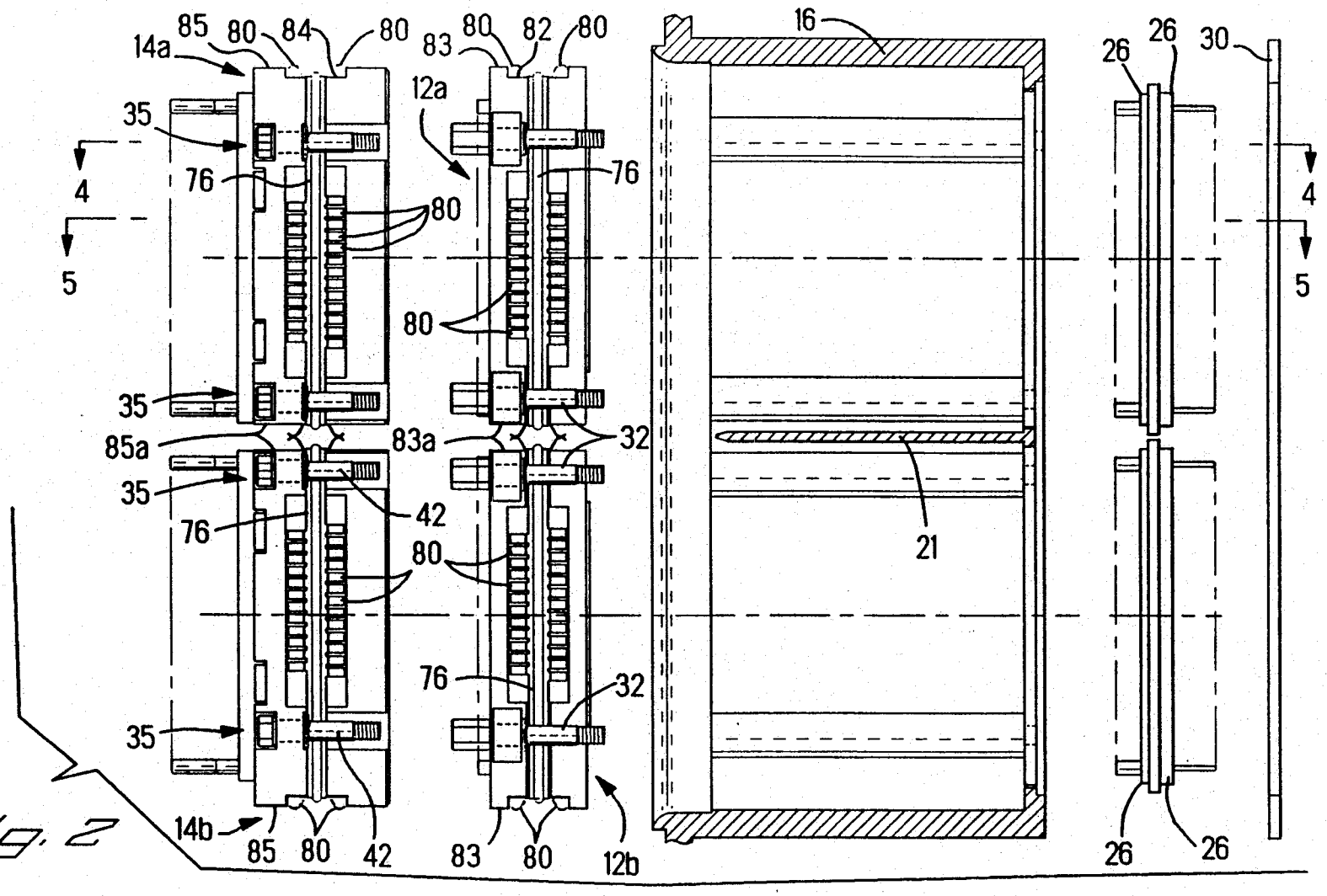
FIG. 2 is a cross-sectional view of the modular connector assembly of FIG. 1.
Figure 3:
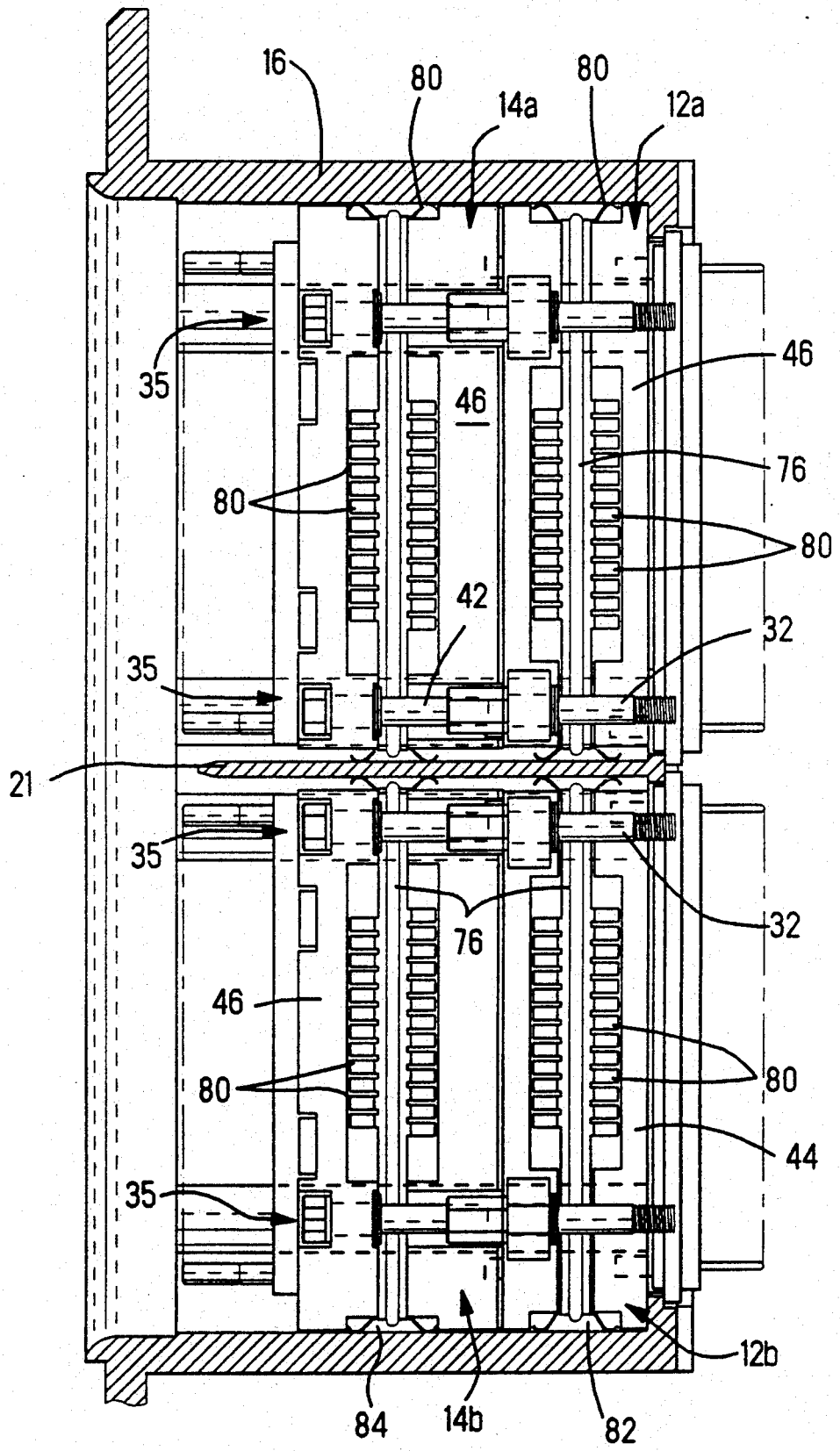
FIG. 3 is a cross-sectional view of the assembled modular connector assembly of FIG. 2.

Turning now to the drawings, FIGS. 1 to 3 illustrate a modular connector assembly according to a presently preferred embodiment of the invention. The modular connector assembly 10 comprises a plurality of filter modules 12*a*,12*b* and a plurality of transient suppression modules 14*a*,14*b* supported within a main shell assembly (or member) 16. As shown in FIG. 1, the main shell assembly 16 is configured to define an axially deep, well-like module-receiving aperture 20, which in this embodiment of the invention, is divided into an upper aperture 20*a* and lower aperture 20*b* by a divider wall 21 formed integrally on the back of the main shell assembly 16. The filter (or first) modules 12*a*,12*b* are adapted to be first positioned within the aperture 20, and transient suppression (or second) modules 14*a*,14*b* are adapted to be positioned within the aperture 20 and electrically engage the filter modules 12*a*,12*b*.

As shown in FIGS. 1 to 3, the upper filter module 12*a* may be a mirror image of lower filter module 12*b* and the same is true for the upper and lower transient suppression module 14*a*,14*b*. The filter modules 12*a*,12*b* are retained within the aperture 20 by a shoulder 22 positioned around the periphery of the rear of the main shell assembly 16, which in turn retains the transient suppression modules 14*a*,14*b* within the apertures 20*a*,20*b*. Edges of a pin grid array 24 including a planar dielectric member and an interfacial seal 26 is sandwiched between the main shell assembly 16 and retainer plates 30*a*,30*b* secured thereto such as by fasteners 31 in corresponding apertures extending into the mounting face of the main shell. The interfacial seal 26 is typically made from silicone rubber, fluorosilicone or the like, and prevents the entry of dust and other contaminants into the module connector assembly during use.

Figure 4:
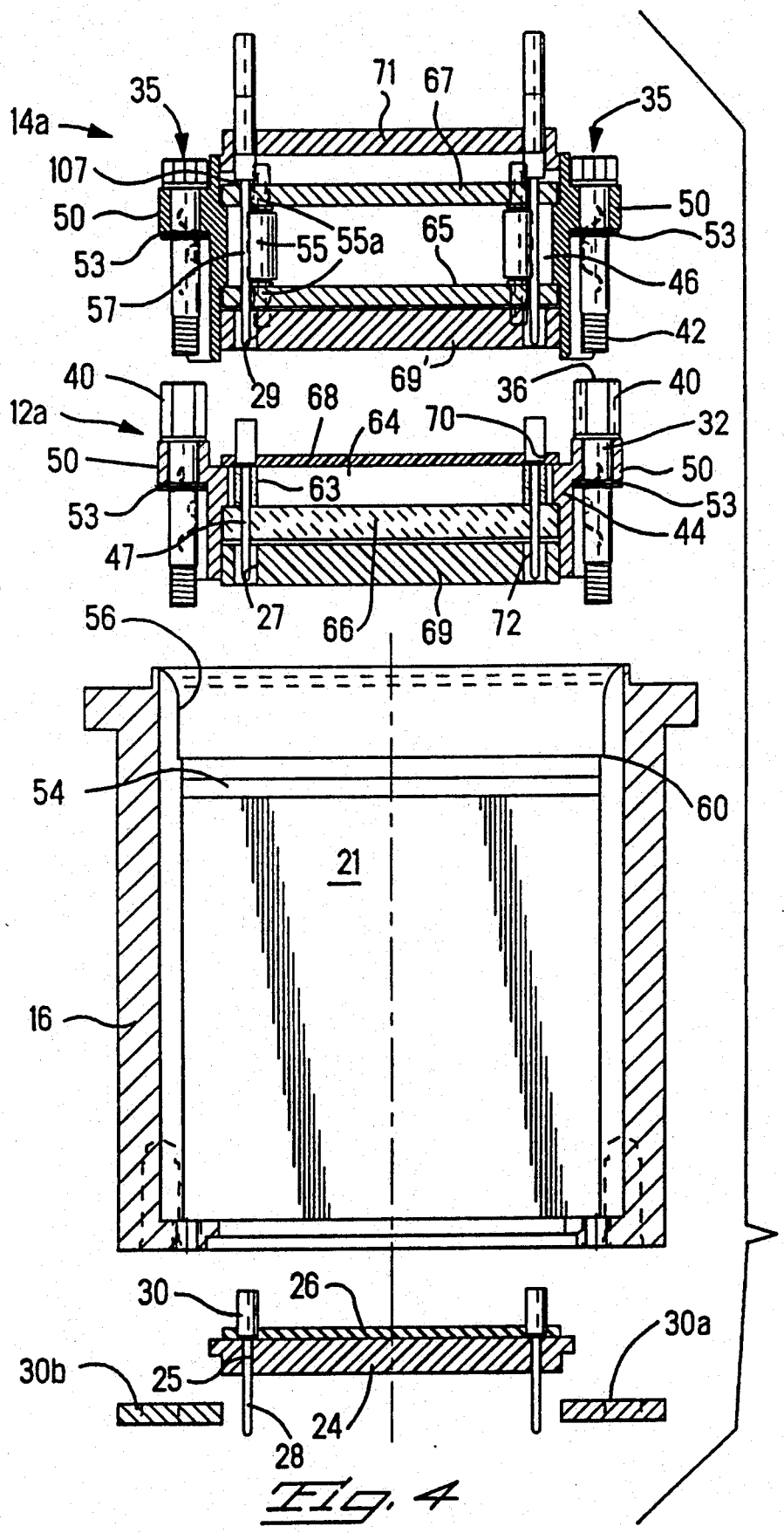
FIG. 4 is a cross-sectional view of the modular connector assembly taken along line 4—4 of FIG. 2.
Figure 5:
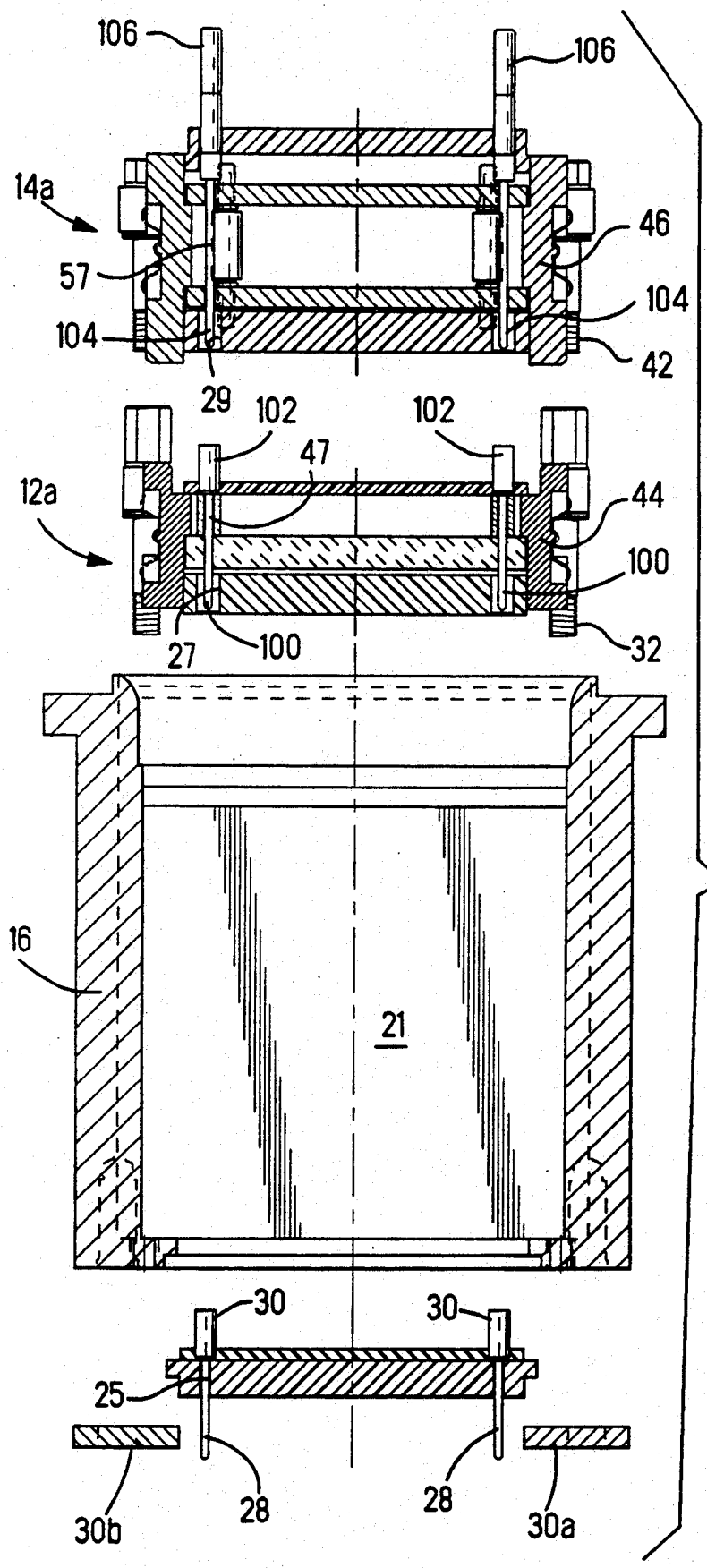
FIG. 5 is a cross-sectional view of the modular connector assembly taken along line 5—5 of FIG. 2.

The planar dielectric member of the pin grid array 24 and the interfacial seal 26 and are each provided with a plurality of apertures 25 (FIGS. 4 and 5) through which extend first terminals which include forward contact sections 28 exposed at a mating face of the connector assembly to become electrically interconnected with complementary contact sections of contacts of a mating connector (not shown). Apertures 25 are aligned with apertures 27 formed in the filter modules 12*a*,12*b*, and apertures 27 will in turn be aligned with apertures 29 formed in the transient suppression modules 14*a*,14*b* upon assembly of the modular connector assembly 10 as shown in FIGS. 4 and 5. Each of the apertures 25,27,29, respectively are adapted to receive a respective plurality of first, second and third contacts or terminals each having pin contact sections, respectively 28,104,100—and socket contact sections, respectively 30,106,102—, which form a plurality of interconnected electrical terminals within the modular connector assembly 10 when assembled.

The main shell assembly 16 so constructed can then be mounted to a bulkhead or other mounting surface by screws or the like (not shown) extended through respective holes of a mounting flange positioned around the periphery of the main shell assembly 16 proximate a mating face thereof. Typically, the main shell assembly 16 is constructed of aluminum and finished in clear cadmium plate.

The filter modules 12*a*,12*b* and the transient suppression modules 14*a*,14*b* are both mounted by modular assembly means 35 within the main shell assembly 16 in a removable manner. Preferably, the modular assembly means comprise jack-screws 32 or the like which mount and secure the filter modules 12*a*, 12*b* to openings 34 in the shoulder 22 of the main shell assembly 16. Jack-screws 32 include openings 36 in the heads 40 of the screws having threaded inner portions which in turn receive mounting screws 42 or the like to secure the transient suppression modules 14*a*, 14*b*. During assembly, a conventional relatively weak adhesive is placed in openings 34 of the main shell to increase resistance to unthreading jack-screws 32, while a conventional lubricant is placed in the jack-screw openings 36 having threads or the like which assures that later during disassembly the mounting screws will first rotate to threadedly disengage from the jack-screws rather than inadvertently transmit torque to the jack-screws, when the mounting screws are removed to replace a module.

Each of filter modules 12*a*,12*b* and transient suppression modules 14*a*,14*b* include a subassembly shell 44,46 which holds unthreaded shank portions of the jack-screws and mounting screws 32,42 respectively in larger diameter holes through projection members 50 along side surfaces 83,85 of subassembly shells 44,46. Each of the jack-screws 32 and mounting screws 42 have an annular groove 51 forwardly of projection members 50 to receive retaining E-rings 53 which hold the jack-screws 32 and mounting screws 42 within the projection members 50 and thus retained to subassembly shells 44,46. This allows the jack-screws 32 and the mounting screws 42 to be oriented in axial alignment but be free to be rotated. The projection members 50 have a generally arcuate shape to match the axially extending groove (or slot) 52 formed in the main shell assembly 16. In this manner, the filter and transient suppression modules 12*a*,12*b*;14*a*,14*b* are guided into the main shell assembly 16 by the projection members 50 of the subassembly shells 44,46 sliding along the axially extending grooves 52 of the main shell member 16. A tapered end 54 of the divider wall 21 also provides initial spacing or "float" clearance thereby providing guidance between the two filter modules 12*a*,12*b* or the two transient suppression modules 14*a*,14*b* as they are inserted into the main shell member 16. Typically, the filter and transient suppression subassembly shells 44,46 are made of aluminum with a gold flash over electroless nickel. The jack-screws 32 are preferably made of stainless steel with a passivated finish.

One or more of the transient suppression modules 14*a*,14*b* can easily be removed or replaced when desired without replacing the modular connector assembly 10 as a whole and without interfering with the remaining transient suppression module and the filter modules or other modules of like kind in the modular connector assembly 10. Similarly, after removal of one of the transient suppression modules 14*a*,14*b*, the associated filter module 12*a*,12*b* can easily be removed or replaced as desired without replacing the modular connector assembly 10 as a whole and without interfering with the other transient suppression and filter or other modules of a like kind in the modular connector assembly 10.

As shown in FIGS. 1 , 2, 4 and 5, the filter modules 12*a*,12*b* are positioned in front of the main shell assembly 16. The main shell assembly 16 along its front periphery or mating face includes a curved surface 56 which defines an enlarged aperture 20' having a lead-in which facilitates mating with a corresponding connector (not shown) and also serves to facilitate the insertion of the filter modules 12*a*,12*b* and later the transient suppression modules 14*a*,14*b* into the aperture 20. A lip 60 is defined between the curved surface 56 of the main shell member 16 and the inner bearing surface 62 of the main shell member 16.

By way of example, the filter modules 12*a*,12*b* each comprise the subassembly shell 44 which includes a filter subassembly having filter components such as tubular ferrite beads 63 electrically engaging and surrounding each contact 47 and mounted in region 64 between a planar capacitor 66 of plated ceramic material for grounding to subassembly shell 44 when capacitor 66 is bonded to the inner surface of subassembly shell 44 such as by solder or conductive epoxy, with the filter subassembly being mounted within a front interfacial seal 69 and rear housing plate 68. Region 64 is preferably filled with dielectric potting material. The filter module 12*a*,12*b* may also comprise various types of filters as are known in the art depending on the particular application in which the assembly is to be used, and need not be described in detail herein. For example, the filter modules 12*a*,12*b* may include a tubular ferrite capacitor and planar capacitor as shown herein, or a distributed element filter such as disclosed in U.S. Pat. No. 29,258. As described in U.S. Pat. No. 4,262,268, the filter module 12*a*,12*b* may also include a pi-section LC filter.

The front interfacial seal 69 of the filter modules 12*a*,12*b* is preferably made of fluorosilicone rubber. The rear of the modules 12*a*,12*b* includes a hard plastic insert 68 preferably formed of a relatively rigid dielectric material such as a thermosetting epoxy; one suitable material for rear plate 68, for example, is glass-filled reinforced epoxy molding compound marketed by Plaskon, Inc. under the trademark EPIALL.

By way of example, second electrical terminals 47 in the filter modules 12*a*,12*b* include elongated forward pin contact sections 100 and socket contact sections 102. The pin contact sections 100 are matable with socket contacts 30 of the pin grid array 24, while the socket contact sections 102 are exposed along the face of the of filter module 12*a*,12*b* to define a mating interface to receive the pin contact sections 104 of the transient suppression modules 14*a*,14*b*.

As shown in FIGS. 4 and 5, a plurality of apertures 72 extend through front interfacial seal 69, and a plurality of apertures 70 extends through rear housing plate 68. The plurality of apertures 70 and 72 are arranged in a generally rectangular pattern to form the array of apertures 27 and are positioned to be in alignment with one another when front interfacial seal 69 and rear dielectric plate 68 are assembled together within filter 44 forwardly and rearwardly of the plurality of filter components 63,66 therebetween.

By way of further example, the transient suppression modules 14*a*,14*b* each comprise the subassembly shell 46 within which is mounted an array of electrical terminals and a transient suppression subassembly between dielectric substrate means. The transient suppression subassembly has transient suppression components such as leaded diodes 55 incorporated therein such as with miniature spring sockets 55*a* engaging the respective leads and mounted in through-holes of opposed printed circuit substrates 65,67, which diodes are electrically grounded at one electrode or lead to the conductive subassembly shell 46 by traces of printed circuit substrate 65 extending to the substrate periphery which is soldered to subassembly shell 46 or affixed thereto by conductive epoxy. The other electrode or lead is electrically connected to a respective third contact 57 at a connection 107 defined by a solder joint of contact 57 to a trace of printed circuit substrate 67. The transient suppression means preferably include bidirectional surface mounted diodes such as those disclosed in U.S. Pat. Nos. 4,709,253; 4,726,638; and 4,729,743. Unidirectional diodes may also be used.

The third electrical terminals 57 of the transient suppression modules are mounted in rear dielectric plate 71 and, like the terminals 47 in the filter modules 12*a*,12*b*, include elongated forward pin contact sections 104 and socket contact sections 106 (FIG. 5). The pin contact sections 104 disposed in apertures of front interfacial seal 69' are matable with socket contact sections 102 of the filter modules 12*a*,12*b*, while the socket contact sections 106 are exposed along the face of the of module connector assembly 10 to define a mating interface for pin contact sections from a connector terminating an array of circuit lines (not shown), such as from various locations within an aircraft, for electrical connection with a control unit via connector assembly 10 secured to a panel of the control unit (not shown).

As shown in FIGS. 1 to 3, each of the filter modules 12*a*,12*b* further include a ground spring 76 (or grounding means) which is adapted to fit within a channel 82 formed on sides 83 of the subassembly shell 44. Preferably, the channels 82 are formed on all sides of the subassembly shell 44 except for the side 83*a* to be adjacent the divider wall 21. Similarly, each of the transient suppression modules 14*a*,14*b* respectively, further include a like ground spring 76 which is adapted to be fit within a channel 84 formed on sides 85 of the subassembly shell 46, respectively. Preferably, the channels 84 are formed on all sides of the subassembly shell 46 except for side 85*a* adjacent the divider wall 21.

Figure 6:
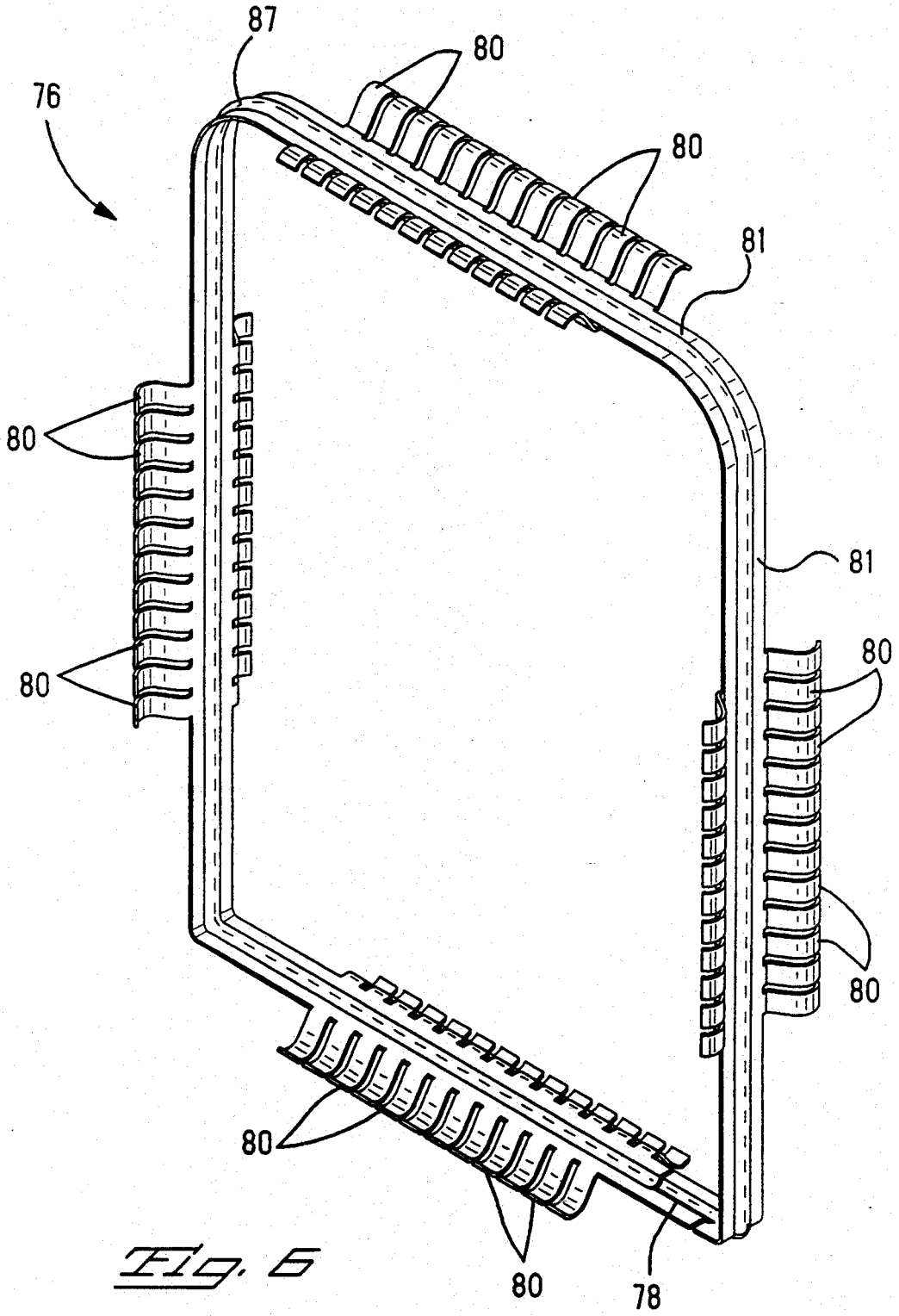
FIG. 6 is an isometric view of the ground spring (or member) of FIG. 1 for providing grounding connections between each of the filter and transient suppression module subassembly shells and the main shell assembly.

As shown in FIG. 6, the ground spring 76 (or grounding means) defines a plurality of spring fingers 80 which extend in "butterfly" or pair fashion from each of the sides 81 of the ground spring 76. The ground spring 76 is constructed of a resilient, electrically conductive metal such as gold-plated or nickel-plated beryllium copper. It functions as an electrical ground for the filter modules 12*a*,12*b* and the transient suppression modules 14*a*,14*b* to the main shell assembly 16 by assuring electrical contact via the arrays of spring fingers 80 between the subassembly shells 44,46 and the main shell assembly 16. A ground strip suitable for use with this invention is described in U.S. Pat. No. 4,874,337 entitled "Method of Mounting A Replaceable EMI Spring Strip", disclosed therein to be mounted around a section of a plug shell matable with a receptacle shell of a mating connector pair.

As shown in FIG. 4, the ground spring 76 may be held in place in the channels 82,84 of the subassembly shells 44,46 by a ridge 87 fitted over a corresponding ridge of subassembly shells 44,46 positioned centrally within channels 82,84 respectively and extending around subassembly shells 44,46. Assembly edges 78 of the ground spring 76 are soldered together or the like to further secure the ground spring 76 to the respective subassembly shells 44,46. This, together with the sides 81 of the ground spring 76 bearing against the sides 83,83*a*;85,85*a* of the subassembly shells 44,46, respectively, when arrays of fingers 80 are compressed by inner bearing surface 62 of main shell assembly 16 secures the grounding spring 76 against axial and lateral movement. In this manner, the grounding spring 76 is easily assembled to the subassembly shell 44 and is easily removable and replaceable.

The spring fingers 80 are integral with sides 81 of the ground spring 76 and extend into portions of the channels 82,84 respectively upon being deflected thereinto when compressed by inner bearing surface 62 of main shell assembly 16 after assembly. The spring fingers 80 not only function as an electrical coupling means to releasably electrically couple the filter modules 12*a*,12*b* and transient suppression modules 14*a*,14*b* to the main shell assembly 16, they also provide an incremental "float" to space the filter modules 12a,12b apart from the inner bearing surface 62 of the main shell assembly and the divider plate. Thus, the spring fingers 80 positioned around the periphery of the filter module 12a,12b and the transient suppression modules 14a,14b engage the conductive main shell assembly 16 when the filter modules are mounted within one of the apertures 20a,20b.

The filter modules 12a,12b and transient suppression modules 14a,14b are designed each to be manufactured as a complete, self-contained unit capable of being installed into or removed from module connector assembly 10 either during manufacture or in the field without disassembly of the module and without interfering in any way with other filter modules 12a,12b or transient suppression modules 14a,14b in the module connector assembly 10.

Merely by way of example, in the embodiment illustrated in FIGS. 1 to 6, the filter modules 12a,12b and transient suppression modules may each comprise a 150-contact module. Accordingly, rear plate 68, as well as other contact-receiving components of the filter module, have 150 apertures extending therethrough which will be in alignment with one another when the filter modules 12a,12b, and transient suppression modules 14a,14b are assembled.

Figure 7:
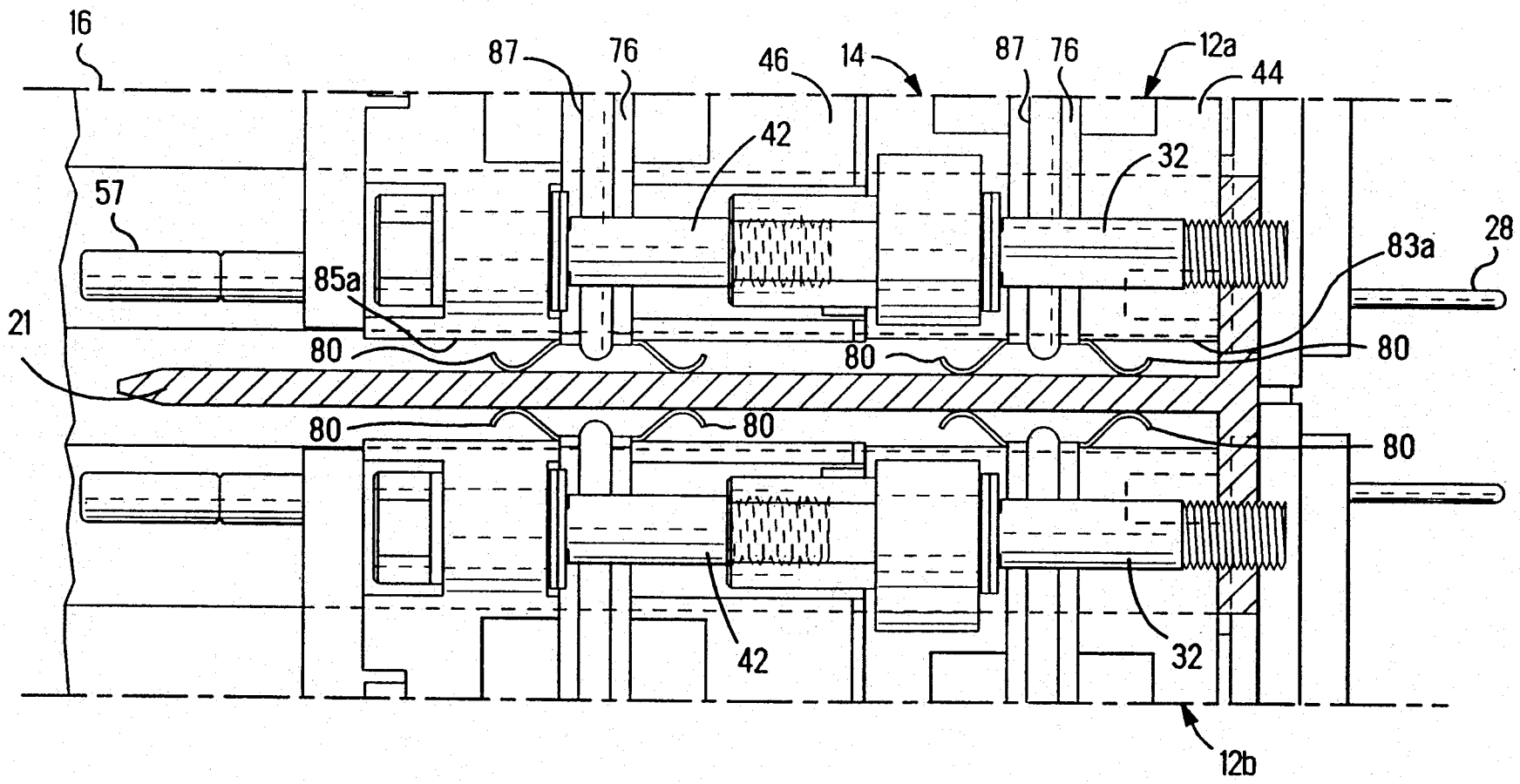
FIG. 7 is an enlarged cross-sectional view of the first aligning means of the main shell positioned between the filter and transient modules as shown in FIG. 3.

The modular connector assembly 10 of the present invention is assembled in the following manner. As shown in FIGS. 1, 2 and 4, the jack-screws 32 of the filter modules 12a,12b are retained to module subassembly shells 44 by the E-rings 53. The filter modules 12a,12b are inserted in a close fit within axially elongate, deep or well-like apertures 20a,20b of the main shell assembly 16 to slightly compress the spring fingers 80 of the ground spring 76 as the spring fingers 80 bear against the inner bearing surface 62 and the divider wall. As shown in FIGS. 3 and 7, the spring fingers 80 provide a "float" clearance between the four surfaces defined by the divider wall 21 and subassembly shells 44, respectively. Upon full insertion of the filter modules 12a,12b within the apertures 20a,20b, the pin contact sections 100 of the filter modules 12a,12b engage the socket contact sections 30 of the pin grid array 24. At that point, the jack-screws 32 are rotated simultaneously (or incrementally and sequentially) so that as the filter modules 12a,12b move forward into the deep apertures absent pitch and yaw in a planar fashion towards the pin grid array 24, the pin contacts 100 of the filter modules 12a,12b engage in proper alignment the socket contact sections 30 of the pin grid array 24 without damage. A suitable tool (not shown) to provide simultaneous rotation of the jack-screws is described in U.S. patent application No. 07/818,301, entitled "Tool For A Modular Connector" filed Jan. 8, 1992 and assigned to AMP Incorporated of Harrisburg, PA. Alternatively, a hand tool which engages the screws may be used to provide incremental rotation of each of the jack-screws 32 in sequence. Preferably jack-screws 32 are adapted for rotation by hexagonally headed screw driver tooling, by the outer portion of aperture 36 being hexagonal in cross section.

In a like manner, the transient suppression modules 14a,14b are inserted within the apertures 20a,20b of the main shell assembly 16 to slightly compress the spring fingers 80 of the ground spring 76 as the spring fingers 80 bear against the inner bearing surface 62 and the divider wall 21. The projection members 50 of the filter modules 12a,12b fit within the axially extending grooves 52 of the main shell assembly 16. As shown in FIGS. 3 and 7, the spring fingers 80 provide a "float" clearance between the four surfaces defined by the divider wall 21 and subassembly shells 44, 46. The float clearance can be a predetermined clearance of about 0.005 to 0.010 inches between the transient suppression modules 12a,12b and the main shell assembly 16 upon engagement of the ground spring 76 with the clearance permitting assembly and disassembly.

Upon full insertion of the transient suppression modules 14a, 14b within the apertures 20a,20b, the pin contact sections 104 of the filter modules 12a,12b engage the socket contact sections 102 of the filter modules 12a,12b. At that point, the screws 42 are rotated simultaneously (or incrementally and sequentially) so that as the transient suppression modules 12a,12b move forward in planar fashion towards the filter modules 12a,12b, the pin contact sections 104 of the transient suppression module 12a,12b engage the socket contact sections 102 of the filter modules 12a,12b in proper alignment without damaging the contacts. Again, a suitable tool (not shown) to provide simultaneous rotation of the screws 42 is described in U.S. patent application No. 07/818,301 with heads of mounting screws 42 being hexagonally apertured. Alternatively, a hand tool which engages the screws may be used to provide incremental rotation of each of the screws 42 in sequence.

As described above, the combination of the projection members 50 on the filter and transient suppression modules 12a,12b;14a,14b fitting within the axially extending grooves 52 of the main shell assembly 16 together with the spring fingers 80 providing a "float" between the subassembly shells 44,46 and assure that the filter modules 12a,12b are properly aligned with the pin grid array 24. Similarly, the same features assure that the transient suppression modules 14a,14b are properly aligned with the filter modules 12a,12b. Thus the filter modules 12a,12b and transient suppression modules 14a,14b can easily be removed or replaced when desired without replacing the modular connector assembly 10 as a whole. Also, to assure protective grounding, the ground spring 76 may easily be replaced if damaged or fatigued through use.

Variations on the embodiments described above are possible. For convenience and flexibility, the modular connector assembly 10 is of modular construction as both the main shell assembly 16 and the filter and transient suppression modules 12a,12b;14a,14b, respectively, may be manufactured in a variety of configurations. To construct an assembly suitable for a particular application, it is only necessary to select the appropriate shell and modules and to secure the modules within the shell. Similarly, while pin and socket contacts are described, other forms of engaging contacts may also be used.

In yet a further variation, other shell configurations may be provided to support one or any desired plurality of modules, and it is not intended to limit the invention to any particular shell configuration. Similarly, in the embodiment illustrated in FIG. 1, module configurations are shown which differ in the number, type and placement of their contacts. These are intended to be exemplary only, and it is also not intended to restrict the invention to any particular module configuration.

In yet a further variation, while there are many applications in which it would be desirable for one or more of the filter or transient suppression modules in modular connector assembly 10 to have a filtering capability, for example, to suppress electromagnetic interference and transient suppression means to suppress energy surges such as from lightning, electromagnetic pulse and electrostatic discharge or other unwanted signals or energy which may exist in circuits connected by the modules, the present invention is not limited to the use of either filter or transient suppression modules. To retain the convenience and flexibility of the modular construction of modular connector assembly 10, however, it is desirable that any electrical terminal module, including both filter or transient modules may be used in the present invention. Further, all such modules are preferably fully interchangeable.

In yet another variation, the main shell member 16 may be configured in a manner shown in FIG. 1 where a single filter or transient suppression module is used in multiple positions within the main shell member. For example, as shown in FIGS. 1 to 3, the upper filter module 12*a* is a mirror image of lower filter module 12*b* and the same is true for the upper transient suppression module. Many other configurations, including main shell members having four, six or eight modules and so on may be utilized. This flexibility allows the ultimate end user to necessarily maintain only a limited number of replacement modules.

The embodiments described above provide a number of significant advantages of providing a modular connector assembly having EMI filter modules and an EMP/ESD/lightning transient suppression protection modules having improved mounting and replacement modularity and electrical grounding characteristics, particularly for high density, multi-contact electrical circuit assemblies. Each of the modules of present invention comprise a conductively enveloped subassembly which provides electrical grounding through a ground spring to the main (or outer) shell assembly. The ground spring affixed to each of the modules is replaceable and provides an incremental "float" which facilitates the insertion and removal of each of the modules. It also provides a degree of vibration control between the main shell assembly and the subassembly shells thereby protecting electrical components within the modules.

Of course, it should be understood that a wide range of changes and modifications can be made to the preferred embodiment described above. It is therefore intended that the foregoing detailed description be understood that it is the following claims, including all equivalents, which are intended to define the scope of this invention.

I claim:

1. A modular connector assembly comprising:

a conductive main shell assembly having an axially elongate aperture therethrough defining an inside surface, said main shell assembly defining a first aligning means disposed within said aperture;

a first module disposed entirely within said aperture, said first module comprising a first conductive subassembly shell containing an inset carrying a plurality of first electrical terminals having electrical contacts defining a preselected array of circuit paths, said first module having circuit protection elements disposed thereon electrically connected to corresponding said first terminals and electrically grounded to said first subassembly shell;

a first ground spring secured around and disposed to engage said first subassembly shell and said inside surface of said main shell assembly in electrical contact thereby providing an electrical ground between said first module and said main shell assembly; and at least one first fastener cooperable with said first subassembly shell and said main shell assembly for fastening said first module within said main shell assembly in a manner disposed to maintain during assembly the alignment of said first electrical contacts of said first module axially with said main shell assembly, said first ground spring providing an incremental float thereby defining a predetermined clearance between said first subassembly shell of said first module and said main shell assembly upon engagement of said first ground spring with said first aligning means.

2. The assembly of claim 1, wherein said assembly comprises a second module disposed in said aperture, said second module comprising a second conductive subassembly shell containing an insert carrying a like plurality of second electrical terminal contacts defining a like array of circuit paths, said second module having circuit protection elements disposed thereon electrically connected to respective said second ground terminals and electrically grounded to said second subassembly shell, said second contacts of said second module disposed to mate with said first contacts of said first module;

a second ground spring secured around and disposed to engage said second subassembly shell and said inside surface of said main shell assembly in electrical contact thereby providing an electrical ground between said second module and said main shell assembly; and at least one second fastener cooperable with said at least one first fastener for securing said second module within said main shell assembly in a manner disposed to maintain during assembly the alignment of said second contacts of said second module axially with said first electrical contacts of said first module.

3. The assembly of claim 2 wherein said first module comprises a filter module and said second module comprises a transient suppression module.

4. The assembly of claim 2, wherein said main shell assembly further comprises a second aligning means disposed on said inside surface of said aperture, and first and second modules include guide means.

5. The assembly of claim 1, wherein said first module comprises a filter module defining a guide means disposed to engage said first aligning means of said main shell assembly.

6. The assembly of claim 2, wherein said second module comprises a transient suppression module defining a guide means to engage said second aligning means of said main shell assembly.

7. The assembly of claim 5 wherein said filter module includes at least one dielectric substrate member having a first conductive path means disposed thereon electrically grounded to said first subassembly shell, and a plurality of apertures extending therethrough for receiving therethrough a plurality of said first electrical terminals, and filter means electrically connected to said first electrical terminals and grounded to said first conductive path means.

8. The assembly of claim 5 wherein said transient suppression module includes at least one dielectric substrate member having a second conductive path means disposed thereon electrically grounded to said second subassembly shell, and a plurality of apertures extending therethrough for receiving therethrough a plurality of said second electrical terminals, and transient suppression means electrically connected to said second electrical terminals and grounded to said second conductive path means.

9. The assembly of claim 1 wherein said ground spring includes a pair of arrays of spring fingers along at least portions of sides of said first subassembly shell.

10. The assembly of claim 3, wherein said at least one first fastener includes a plurality of jack-screws disposed to fasten said filter module to said main shell assembly and said at least one second fastener includes a plurality of screws disposed to fasten said transient suppression module to said first module, said jack-screws adapted to threadedly receive thereinto respective said screws.

11. The assembly of claim 4, wherein said first aligning means includes axially extending grooves formed on the inside surface of said main shell assembly and said guide means includes projections formed on each of said first subassembly shell and said second subassembly shell of said filter and transient suppression modules through apertures of which extend said fastening means and said cooperable modular fastening at least one first fastener and said at least one second fastener.

12. The assembly of claim 1 wherein at least two modules are disposed within respective apertures of said main shell assembly, each of said modules being a mirror image of one another.

13. A modular connector assembly comprising a main shell member having an axially elongate aperture therethrough defining an inside surface, a circuit assembly disposed in said main shell aperture, said circuit assembly including a filter module and a transient suppression module containing respective pluralities of first and second electrical terminals, said filter module including at least one dielectric substrate having conductive path means disposed thereon, a plurality of apertures extending therethrough for receiving a respective plurality of said first electrical terminals, and filter members electrically engaging said first electrical terminals thereof, and said transient suppression module including at least one dielectric substrate member having a conductive path means disposed thereon, a plurality of apertures extending therethrough for receiving a plurality of second electrical terminals, and transient suppression means electrically connected to said second electrical terminals thereof, said filter and transient suppression module each including grounding means disposed to engage said inside surface of said main shell aperture in electrical contact to ground said filter members and transient suppression means respectively, and defining a guide means disposed to engage aligning means of the main shell member.

14. The invention of claim 13 wherein said grounding means comprises a spring including a pair of arrays of spring fingers.

15. A filter module for use in a modular connector assembly containing one or more modules releasably mounted within an aperture of an outer shell comprising a conductive subassembly shell having a plurality of electrical contacts insulatively secured therein and a filter means electrically engaged with said electrical contacts, said filter means electrically engaged with said subassembly shell, said conductive subassembly shell disposed to be placed into said outer shell aperture, said filter module having grounding means disposed to engage said inside surface of said aperture and said conductive subassembly shell in electrical contact, said filter module defining a guide means disposed to engage aligning means of said outer shell member whereby said grounding means additionally disposed to define a predetermined clearance between said subassembly shell and said outer shell.

16. A transient suppression module for use in a modular connector assembly containing one or more modules releasably mounted within an aperture of an outer shell comprising a conductive subassembly shell having a plurality of electrical contacts insulatively secured therein and transient suppression means electrically engaged with respective said electrical contacts, said transient suppression means electrically engaged with said subassembly shell, said conductive subassembly shell disposed to be placed into said outer shell aperture, said transient suppression module having grounding means disposed peripherally about an outer surface thereof to engage said inside surface of said aperture and said transient suppression subassembly shell in electrical contact, said transient suppression module defining a guide means disposed to engage aligning means of said outer shell member whereby said grounding means is additionally disposed to define a predetermined clearance between said subassembly shell and said outer shell.

17. A method of assembling a circuit assembly within a shell member having an axially elongate aperture to form a modular connector assembly, comprising the steps of:

providing a shell member having an axially elongate aperture therethrough defining an inside surface, said shell member defining a plurality of axially aligned fastening apertures through a flange peripherally about a selected axial location along said axially elongate aperture member defining an insertion depth, and each of said fastening apertures being positioned an equal distance inwardly of said inside surface;

providing a circuit assembly shaped and dimensioned to be disposed transversely in said aperture in a close fit and having an axial dimension substantially less than that of said axially elongate aperture of said shell member;

providing a resilient means about side surfaces of said circuit assembly adapted to be engageable with said inside surface of said axially elongate aperture of said shell member and incrementally compressible thereby during assembly for centering said circuit assembly within said inside surface;

providing a plurality of rotatable fastening means spaced about the periphery of said circuit assembly corresponding to and threadable into respective said shell fastening apertures, and said rotatable fastening means being engageable from a common direction for actuation;

positioning said circuit assembly within an insertion end of said axially elongate aperture of said shell member in a transverse orientation with exposed threaded ends of said rotatable fastening means adjacent respective said shell fastening apertures for entry thereinto; and engaging and rotating said plurality of rotatable fastening means simultaneously at equal angular speeds to urge said circuit assembly along said axially elongate aperture of said shell member and become mounted therewithin adjacent said flange, thereby threading said rotatable fastening means into respective said fastening apertures, whereby said circuit assembly is continuously maintained in a transverse orientation during assembly into said shell member.

18. A method of assembling a modular connector assembly comprising:

providing a main shell member having an axially elongate shell member defining an aligning means disposed within said aperture;

providing a circuit assembly disposed in said aperture in a close fit and having a filter module and a transient suppression module in electrical engagement with a plurality of electrical terminals, said filter and transient suppression modules each having a conductive subassembly shell;

positioning said filter module having first electrical contacts electrically engaged with said subassembly shell thereof into said main shell assembly aperture, said filter module having grounding means disposed to engage said inside surface of said aperture and said filter subassembly shell in electrical grounding contact, said filter module defining a guide means disposed to engage said aligning means of said main shell member; and positioning said transient suppression module having second electrical contacts electrically engaged with said subassembly shell thereof into said main shell member aperture to engage said filter module, said transient suppression module including grounding means disposed to said electrical contacts and engage said inside surface of said aperture and said transient suppression subassembly shell in electrical grounding contact, said transient suppression module defining a guide means disposed to engage said aligning means of said main shell member; and providing module assembly means on each of said filter and transient suppression modules thereby moving said transient suppression module into said filter module thereby engaging said transient suppression module electrical contacts with said filter electrical contacts in proper alignment;

whereby said grounding means is additionally adapted to define a predetermined clearance between said subassembly shells and said main shell assembly to facilitate said connection of said transient suppression module to said filter module.

19. The method of claim 18, wherein said grounding means defines a spring having a plurality of spring fingers extending therefrom.

20. The method of claim 18, wherein said module assembly means includes a plurality of jack-screws affixed to said filter module and a plurality of screws affixed to said transient suppression module, said jack-screws adapted to threadedly receive respective said screws thereinto.

21. The method of claim 18, wherein aligning means includes axially extending grooves formed on the inside surface of said main shell assembly and said guide means includes projections formed on each of said filter and transient suppression modules.

* * * * *

UNITED STATES PATENT AND TRADEMARK OFFICE

CERTIFICATE OF CORRECTION

PATENT NO. : 5,219,296

DATED : June 15, 1993

INVENTOR(S) : Hung Thai Nguyen

It is certified that error appears in the above-identified patent and that said Letters Patent is hereby corrected as shown below:

Column 11, line 60, claim 1, "inset" should be --insert--

Column 12, line 24, claim 2, delete "ground"

Column 15, line 10, claim 18, after "shell member" insert --aperture therethrough defining an inside surface, said main--

Signed and Sealed this

Twelfth Day of April, 1994

Bruce Lehman

*Attest:*

BRUCE LEHMAN

*Commissioner of Patents and Trademarks*

*Attesting Officer*